United States Patent [19]

Schwarzl et al.

[11] Patent Number: 4,899,032

[45] Date of Patent: Feb. 6, 1990

[54] ELECTRIC HEATING ELEMENT UTILIZING CERAMIC PTC RESISTORS FOR HEATING FLOORING MEDIA

[75] Inventors: Helmut Schwarzl, Leutschach; Josef Unterlass, Graz, both of Austria

[73] Assignee: Siemens Aktiengesellschaft, Berlin and Munich, Fed. Rep. of Germany

[21] Appl. No.: 166,011

[22] Filed: Mar. 9, 1988

[30] Foreign Application Priority Data

Mar. 12, 1987 [DE] Fed. Rep. of Germany ..... 3708056
Mar. 12, 1987 [DE] Fed. Rep. of Germany ..... 8703749

[51] Int. Cl.[4] ..... H05B 1/02; H05B 3/14; H05B 3/20; H01C 7/02

[52] U.S. Cl. ..... 219/375; 219/381; 219/505; 219/530; 219/540; 219/541; 338/22 R

[58] Field of Search ..... 219/374–376, 219/381, 382, 296, 298, 302, 504, 505, 541, 530, 540; 338/22 R

[56] References Cited

U.S. PATENT DOCUMENTS

| | | | |
|---|---|---|---|
| 3,898,422 | 8/1975 | Fuller et al. . | |
| 4,284,877 | 8/1981 | Abura et al. | 219/222 |
| 4,316,077 | 2/1982 | Carlson | 219/381 X |
| 4,334,141 | 6/1982 | Roller et al. | 219/302 X |
| 4,343,988 | 8/1982 | Roller et al. | 219/302 |
| 4,346,285 | 8/1982 | Nakamura et al. | 219/381 |
| 4,371,777 | 2/1983 | Roller et al. | 219/298 |

FOREIGN PATENT DOCUMENTS

| | | | |
|---|---|---|---|
| 0194507 | 9/1986 | European Pat. Off. . | |
| 2804749 | 8/1979 | Fed. Rep. of Germany | 219/302 |
| 53-125641 | 11/1978 | Japan | 219/381 |
| 56-100262 | 8/1981 | Japan | 219/381 |
| 2090710A | 7/1982 | United Kingdom . | |
| 2076270A | 11/1982 | United Kingdom . | |

OTHER PUBLICATIONS

Kaltleiter als Heinzelemente, Technische Information 830314, Valvo.

*Primary Examiner*—Anthony Bartis

[57] ABSTRACT

A heating element for heating a flowing medium includes a heat exchanger made of a plurality of metallic bodies. The metallic bodies have a plurality of passageways extending therethrough and widened on an inlet side in a conical fashion. Positive temperature coefficient (PTC) ceramic resistor are located between adjacent metallic bodies and are encased in a synthetic resin material. The same synthetic resin material is used to form bridges extending through some of the passageways which mechanically fix adjacent metallic bodies to each other. When the heating element is combined with a pipeline system, an annular ring of the same synthetic resin material surrounds the heating element to thermally and electrically insulate the heating element from the pipeline. The PTC heating elements are electrically coupled and mechanically fixed to the metallic bodies by an adhesive, and the metallic bodies thus serving as current supply conduits.

17 Claims, 4 Drawing Sheets

ELECTRIC HEATING ELEMENT UTILIZING CERAMIC PTC RESISTORS FOR HEATING FLOORING MEDIA

BACKGROUND OF THE INVENTION

1. Field of the Invention

The invention relates generally to a heating element for heating flowing media and, more particularly, to a heating element including a heat exchanger having a metallic body composed of aluminum, copper or alloys containing a high proportion of aluminum or copper and which has regularly arranged passageways extending therethrough which taper slightly at inlet portions in conical fashion in the flow direction, the portion of the metallic body located between the passageways having a volume equal to or greater than the volume of all of the passageways, and the metallic body being heated by disc-like ceramic PTC resistors which are attached to a surface of the metallic body by a thermally and electrically conductive plastic adhesive.

2. Discussion of the Related Art

It is known to use a ceramic PTC resistor, also referred to as a positive temperature coefficient or PTC resistor, as a heater or heating element. A ceramic PTC resistor (i.e., PTC resistor) consists of doped polycrystalline ceramic material of a perovskite structure on a base of barium titanate, and has a fundamental characteristic of a combination of semiconduction and ferroelectricity. As a result of this characteristic, there exists a marked positive temperature coefficient for the ceramic PTC resistor within a specified temperature range, the so-called PTC effect. At a specified temperature, the Curie temperature, which is determined by the material composition of the ceramic PTC resistor, a sudden increase in the resistance of the ceramic PTC resistor occurs, and this increase is by a few powers of ten.

If the ceramic PTC resistor is traversed by a current, it is heated until it reaches the Curie temperature at which, as a result of the sudden increase in resistance, it is scarcely traversed by the current, the energy consumption of the ceramic PTC resistor stabilizes and the ceramic cold conductor begins to cool. As soon as the ceramic PTC resistor has cooled it can again be traversed by current and again become heated. This heat up and cool down process continues in a cyclical fashion to provide a self regulating function of heating of the ceramic PTC resistor. Overheating and, as a result, destruction of the ceramic PTC resistor is thereby prevented. Thus, a ceramic PTC resistor is particularly suited for use as a heating element because of its self regulating characteristic.

The maximum temperature of a heating element made of a ceramic PTC resistor can be adjusted by changing its material composition. At present, maximum temperatures of up to 320° C. can be achieved.

As a rule, ceramic PTC resistors are produced in the form of discs or thin plates, to two oppositely located, large surfaces of which are applied blocking-layer-free metal electrode securing a low contact resistance which contain, for example, silver or nickel. It is known that the ceramic PTC resistor material has a marked sensitivity to specific external influences in the surface area in contact with the metal electrodes as the PTC effect is operative only when a purposive metal covering securing a low contact resistance is provided. Therefore, the metal covering is provided between the ceramic PTC resistor material and the metallic electrode to prevent development of a blocking layer. The metal covering must, in the same way as the ceramic PTC resistor itself, be protected from harmful influences.

The use of ceramic PTC resistors to heat flowing media is known. U.S. Pat. No. 4,334,141, which claims priority from the application resulting in German patent No. PS 28 04 818, discloses an electrical heating device for beverage preparation machines, and the heating action is based upon the use of PTC heating elements. The heating elements are insulated by layers of electrically insulating but good heat conducting material to form heating plate segments. Free spaces between adjacent heating plate segments can be filled with an electrically insulating but good heat conducting filler compound.

German patent application No. OS 28 04 749 and German patent No. 28 04 749 disclose a continuous heater having heating elements which consist of PTC effect ceramic resistor and heat exchangers which consist of cylindrical sectors. The heating elements and heat exchangers form a fundamentally cylindrical structure. The cylindrical sectors are peripherally attached to one another by a cylindrical casing and the heating elements are located between surfaces of adjacent cylindrical sectors. The heating elements are pressed by the surfaces of the sectors when pressure is exerted between the cylindrical sectors.

In order to achieve an electrically insulating but good heat conducting connection between the heating elements and the cylindrical sectors, aluminum oxide ceramic is placed between each heating element and each cylindrical sector. Any spaces not filled by the aluminum oxide ceramic are cast with a heat conducting and electrically insulating filler compound such as silicone rubber.

German patent application No. OS 31 19 302 discloses an air heater. Metal heat-irradiating arrangements are in contact with surfaces of electrodes of respective heating elements which have a positive temperature coefficient. The heating elements can be clamped between two irradiating arrangements by means of heat resistant and electrically conducting silicone adhesive layers. Projecting parts of the electrodes of the heating elements can be connected by conducting wires to electrically conductive adhesive layers. However, the conduction wires can also be connected directly to the irradiating arrangements by means of a heat resistant and electrically conductive adhesive.

Electrically and thermally conductive adhesives for high temperatures are disclosed in U.S. Pat. No. 3,898,422. However, in this patent, a PTC heating element is attached only on one side by means of one of such adhesives to an object which is to be heated. A second side of the PTC heating element is contacted by a clamping spring.

U.S. Pat. No. 4,346,285 discloses another heater which uses a PTC element. Heat irradiating bodies which consist of a good heat conducting material contain holes through which a medium which is to be heated flows. The heat irradiating bodies are connected in heat conducting fashion to the PTC element by the clamping effect of a screw connection or via an electrically insulating adhesive. When an electrically conductive adhesive is used, the heat irradiating bodies are electrically insulated from the PTC element via an additional intermediate layer. In order to protect the PTC element from the medium to be heated, the PTC elements can be surrounded by a ring of plastic material. In order to not disturb the clamping effect of a screw connection, the thickness of this ring is slightly less than the thickness of the PTC element. However, this solution does not provide complete protection because, due to the thickness tolerances of the ring and the PTC element, complete sealing is not ensured.

European Patent Office patent application No. 0 194 507 discloses a heating element for heating flowing media in which a heat exchanger consists of a metallic body which is heated by disc-like ceramic PTC resistors which are attached to a part of the surface of the metallic body by a plastic adhesive. The metallic body consists of good heat conducting metal and is provided with regularly arranged passageways, the proportion of the total volume of the passageways to the overall volume of the metallic body being less than 50%. The ceramic PTC resistors are bonded by adhesive to oppositely located parts of the outer surface of the metallic body, possibly in recesses contained within the metallic body. Thus, in the disclosed heating element, only a one-sided coupling of the heat output of the ceramic PTC resistor is employed. This use of one-sided output coupling reduces the efficiency of the heating element.

SUMMARY OF THE INVENTION

An object of the present invention is to provide a heating element for heating flowing media, particularly, motor vehicle intake air, air-fuel mixture, chassis air and oil, wherein the heating element utilizes the highest possible coupling of the heat output of the PTC resistors, provides substantial protection of the PTC resistors from the media, offers only a low flow resistance to the media, is constructed to be mechanically, electrically and thermally flexible and can be produced cost effectively.

The object is accomplished in accordance with principles of the invention by providing a heating element including a heat exchanger of a metallic body composed of a good heating conducting metal such as aluminum, copper, or an alloy containing a high proportion of aluminum or copper and which has regularly arranged passageways extending therethrough which taper slightly at inlet portions in conical fashion in the flow direction, the portion of the metallic body between the passageways having a volume equal to or greater than the volume of all of the passageways, including the following features:

(a) the metallic body having a plurality of individual bodies, in particular, sections or segments which together form a fundamentally cylindrical arrangement and which also serve as current supply components to PTC resistors;

(b) at least one disk like ceramic PTC resistor located between boundary surfaces of two adjacent individual bodies, each of which is attached by its large end surfaces, which bear coverings, to each of the two boundary surfaces of the adjacent individual bodies by means of an electrically and thermally conductive adhesive;

(c) at least two passageways, one passageway located at each boundary surface of the adjacent individual bodies which are mechanically fixed to one another and contain electrically insulating synthetic resin material which connects the passageways as a pair by means of at least one bridge consisting of the same synthetic resin material;

(d) each cavity which remains between the two boundary surfaces of the adjacent individual bodies and around each ceramic PTC resistor and the adhesive being filled with electrically insulating synthetic resin, material which completely encases the ceramic PTC resistor; and (e) the synthetic resin material forms means for mechanically fixing the individual bodies to each other, to encase each ceramic PTC resistor and to fill each cavity having virtually the same thermal expansion coefficient as the metal of which the heat exchanger is made.

In an advantageous embodiment of the heating element, a unit consisting of the individual bodies (which form the metallic body) is provided with a casing which encloses the peripheral surface thereof in annular fashion.

In another embodiment of the heating element, the synthetic resin material used for the mechanical fixing of the individual bodies, for the encasing of each ceramic PTC resistor, for the filling of each cavity and for the encasing of the metallic body consists of polyphenylene sulphide reinforced by about 30 to 50% by weight with glass fibers and/or microspheres, is injection moldable and is sufficiently elastic in a hardened state at the operating temperature of the heating element.

In yet another embodiment of the heating element, the metallic body casing external dimensions are selected such that the heating element is combined with and installed in a pipeline system.

In a further embodiment of the heating element, the two passageways which are used for mechanical fixing of the individual bodies are open in the direction of their respective boundary surfaces over the entire thickness of the metallic body and together form a channel which is filled with synthetic resin material to form a bridge.

In another embodiment of the heating element, the synthetic resin material filling the two passageways projects on both sides beyond the individual bodies and these projections are connected to one another by the same synthetic resin material to form another bridge.

In yet another embodiment of the heating element, the current is supplied to an individual body via at least one plug which is plugged into at least one opening.

In another embodiment of the heating element, the current is supplied to an individual body via a bracket which is molded thereto.

In another embodiment of the heating element, current supply components are arranged diametrically opposite to one another and are designed as pins so that the heating element is rotatable on the pins upon installation in a pipeline system.

In a further embodiment of the heating element, in order to reduce media flow resistance, the passageways have conically shaped inlets, and the inlets of adjacent passageways intersect so that adjacent passageways are separated from each other by sharp edges.

The advantages provided by the invention include the two-sided adhesion of each PTC resistor to the individual heat exchanging bodies which results in a very good thermal contact between the PTC resistor and the heat exchanger, whereby the generated heat output is coupled in an optimal fashion thereby providing, better feedback for the self regulation effect of the PTC resistor. Furthermore, the construction of the heating element is extremely simple and cost effective as it consists only of the heat exchangers (individual bodies), the PTC resistors, the electrically and thermally conductive adhesive and, the synthetic resin material used to encase each PTC resistor and to mechanically fix the heat exchangers. Additional screw connections or clamping clips are not required.

In a German technical bulletin designated "Technischen Information 830314", entitled "Cold Conductors as Heating Elements" and published by VALVO, a German company that is experienced in this area and manufactures cold conductors, it is stated at page 5, section 5.3, paragraph 2, that in the case of double-sided bonding, due to mechanical tensions in a PTC resistor triggered by the alternating thermal load, there exists the possibility that adhesive bonding used for fixing the PTC resistor to a surface may become detached or that cracks may develop in the PTC resistor plate. However, the present invention avoids these difficulties by employing special mechanical fixing including the use of elastic synthetic resin material in addition to the adhesive bonding. This was proven in an experiment in which three heating elements (honeycomb in shape) were each subjected to 40,000 load cycles with each cycle comprising heating the heating element to 230° C. in approximately 30 seconds, holding the heating element at 230° C. for 2 minutes and then allowing the heating element to cool to room temperature in 3 minutes. All three heating elements functioned fully following these tests. Cracks or detachment phenomena were not observed.

The objects and embodiments of the invention will become more apparent by reference to the attached drawings and the detailed description of the preferred embodiments.

DETAILED DESCRIPTION OF THE PREFERRED EMBODIMENTS

In the following description, general structures of three preferred embodiments will be set forth. Following that, common technical information as well as common structural details will be set forth.

Figure 1:
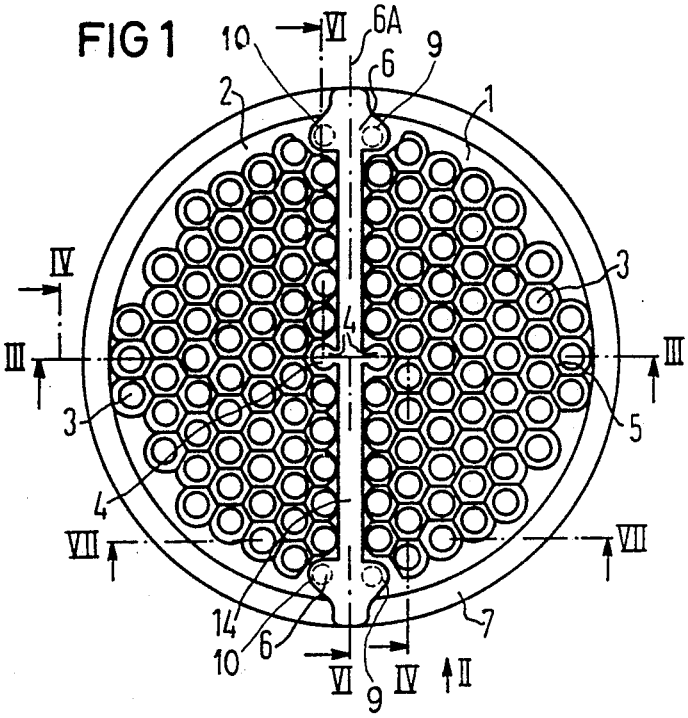
FIG. 1 is a plan view of a heating element embodying principles of the invention.

In FIG. 1 there is shown in plan view a heating element embodying the principles of the invention including a heat exchanger for heating a flowing medium such as air or liquid. The heat exchanger is formed of two individual heat exchanging bodies 1 and 2 which are shaped like cylindrical halves or sectors. The individual bodies 1 and 2 are made of a good heat conducting metal, preferably aluminum, copper or an alloy containing a high percentage of either of these metals. Furthermore, the individual bodies 1 and 2 have regularly arranged passageways 3 through which the flowing medium flows. The passageways 3 provide a honeycomb shape to the heat exchanger.

Figure 3:
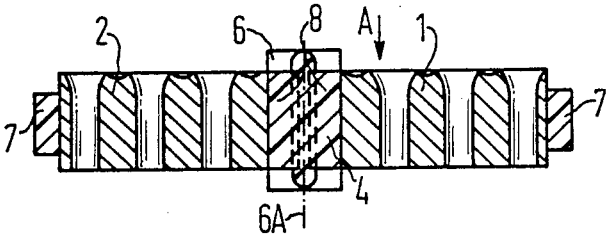
FIG. 3 is a cross sectional view taken along the line III—III of FIG. 1.
Figure 4:
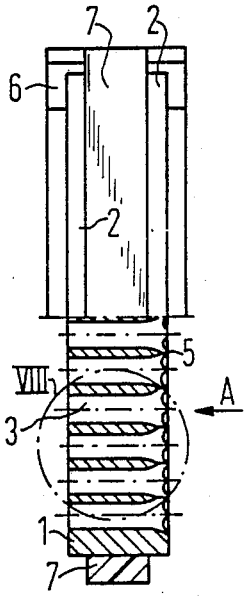
FIG. 4 is partially a side view and partially a cross sectional view of the heating element taken along the line IV—IV of FIG. 1.

In the FIG. 1, the flowing medium flows into the heat exchanger in a direction perpendicular to the plane of the figure as shown more clearly by arrow A in FIGS. 3 and 4. The passageways 3 include conically shaped inlets (except for some as discussed below), which are shown more clearly in FIG. 8. By virtue of the short distances between the individual passageways 3, the conically shaped inlets overlap and form sharp edges 5 which separate adjacent passageways 3 from one another and which provide reduced resistance to the flowing medium. Each passageway 3, which is surrounded by other passageways 3, has a hexagonally shaped inlet periphery due to the pattern of the intersecting inlets.

PTC resistors 11 (FIGS. 5, 6 and 7) are located in a connecting plane 6A between the individual bodies 1 and 2. The PTC resistors 11 are completely enclosed by a synthetic resin material 14 which is described in greater detail below. The passageways 3 formed directly adjacent the connecting plane 6A serve as passageways for connecting bridges 4 and 6. The connecting bridge 4 between these passageways 3 is formed by a milled slot 8 (FIGS. 3 and 5) in an appropriate pair of the individual body passageways 3. The bridge 6 is formed by a link outside of individual bodies 1 and 2 and extends into other passageways 3, shown in FIG. 5 as passageways 9 and 10. In addition, the individual bodies 1 and 2 are preferably surrounded by an annular casing 7 which, when installed in a metal pipe, provides thermal and electrical insulation. The mechanical fixing of the two individual bodies 1 and 2 is carried out only via connecting bridges 4 and 6 so that the annular casing 7 need not be used in the case of installation of the heating element into a non-heat conducting, electrically insulating (where appropriate) synthetic resin pipe. Thus, the bridges 4 and 6 are strong, enough to securely fix the bodies 1 and 2 to each other without the aid of the annular casing 7.

Figure 2:
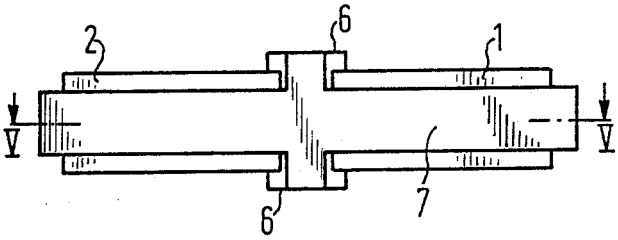
FIG. 2 is a side view of the heating element taken in the direction indicated by the arrow II of FIG. 1.

In FIG. 2, the annular casing 7 is shown surrounding the individual bodies 1 and 2. The bridge 6, which interconnects the individual bodies 1 and 2, is shown extending outside of the individual bodies 1 and 2.

FIG. 3 shows one possibility for the mechanical fixing of the individual bodies 1 and 2. The passageways 3, which are located directly in the connecting plane 6A and which are connected by the connecting bridge 4, have no conical inlets. Instead, a groove 8, more clearly shown in FIG. 5 and open towards the connecting plane 6A, is milled along the entire thickness of the respective individual body 1 or 2 in an appropriate centrally located passageway 3. The connecting channel 8 is filled with the same synthetic resin material which forms the annular casing 7, and this material serves as the bridge 6 and the bridge 4. In the case of the bridge 6, no connecting channel 8 exists between the adjacent passageways 3, instead, the mechanical connection is performed by the bridge 6 itself extending into the appropriate passageways 3.

In FIG. 4, the annular casing 7 and the bridge 6 are shown. In the cross sectional view portion, the sharp edges 5 formed by overlapping inlets of the passageways 3 are clearly shown.

Figure 5:
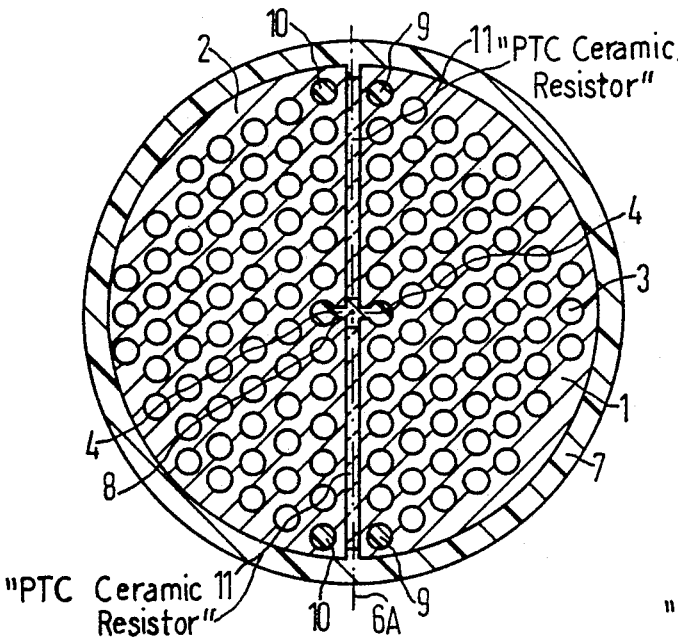
FIG. 5 is a cross sectional view taken along the line V—V of FIG. 2.

In FIG. 5, the cross sectional view of the heating element taken along the line V—V of FIG. 2 is taken below the conical widening of the inlets of the passageways 3 and clearly shows the use of the appropriate passageways 3 for the bridges 4 and 6. The connecting bridge 4 is shown mechanically fixing the individual bodies 1 and 2 through the channel 8 milled into the appropriate central passageways 3. The passageways 9 and 10 are shown without a milled slot as they are connected by the external bridge 6.

As will be apparent to those skilled in the art, the bridges 4 and 6 can be made so as to form an integral unit. They are referred to separately herein simply for ease of understanding of the nature of the mechanical fixing of the individual bodies 1 and 2. Additionally, although only one bridge 4 is illustrated, a plurality of bridges 4 may be employed. Similarly, more than the two bridges 6 illustrated may be used. The principle concern is to maintain an appropriate volume of passageways 3 to ensure minimal flow resistance while adequately heating the medium.

Figure 6:
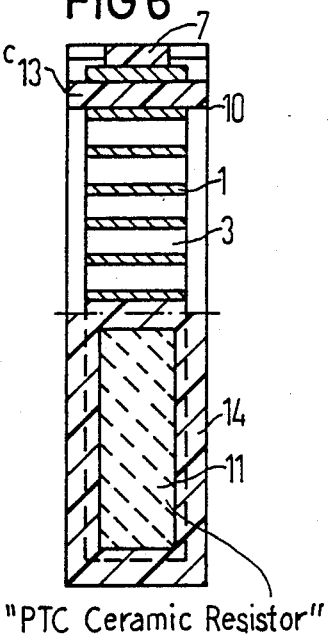
FIG. 6 is a cross sectional view taken along the line VI—VI of FIG. 1.

In FIG. 6, no conical inlets are shown for the passageways 3 as the line VI—VI runs only through passageways 3 which are located along the connecting plane 6A. The synthetic resin material is shown as filling 13 and completely fills the hole 10. The filling 13 continues seamlessly into the bridge 6 which completely surrounds the heat exchanger along the connecting plane 6A. In addition, a PTC resistor 11, which is located in the connecting plane 6A between the individual bodies 1 and 2 and bears a casing 14, is shown.

Figure 7:
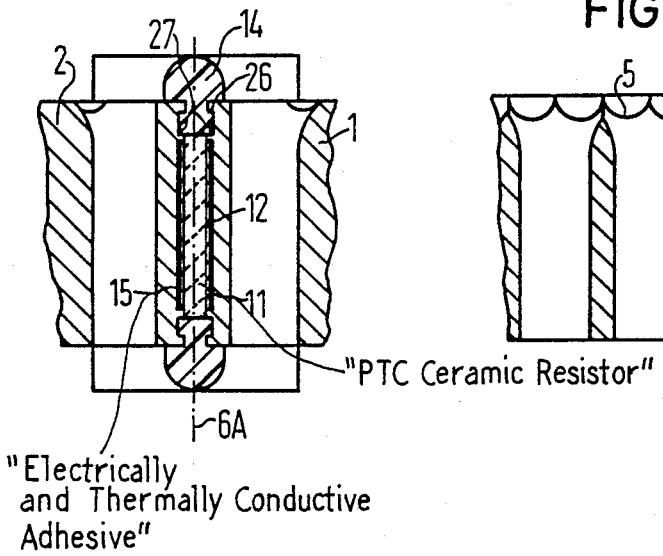
FIG. 7 is an enlarged partial cross sectional view taken along the line VII—VII of FIG. 1.

FIG. 7 shows in greater detail the placement of the PTC element 11 and its encasement. The PTC resistor 11 is sandwiched between metal coverings 12 located on opposite large flat surfaces of the PTC resistor 11 which prevent formation of a blocking layer with a high contact resistance between the PTC resistor 11 and the boundary surfaces of the individual bodies 1 and 2. The metal coverings 12 preferably include predominant amounts of silver or nickel. The coverings 12 are in turn electrically connected and mechanically fixed to the surfaces of the bodies 1 and 2 located along the connecting plane 6A via an electrically and thermally conductive adhesive layer 15. The PTC resistor 11 is completely insulated from the environment and the flowing medium by a synthetic resin material which fills any cavity around the PTC resistor 11 between the boundary surfaces of the individual bodies 1 and 2 to form the casing 14 about the otherwise exposed surfaces of the PTC resistor 11. Additional sealing is achieved by means of a sealing edge 26 located between the boundary surfaces of the bodies 1 and 2 and in a groove 27.

Figure 8:
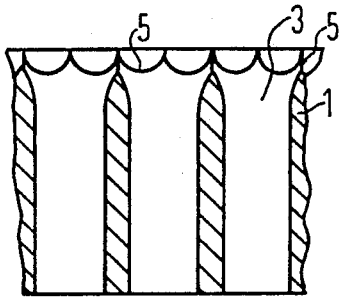
FIG. 8 is an enlarged view of circled area VIII in FIG. 4 showing in detail passageways in the heating element of FIG. 1.

In FIG. 8, the sharp edges 5 of the inlets are clearly visible. By having the inlet edges 5 sharp, the heating element offers less resistance to the flow of the flowing medium.

Figure 9:
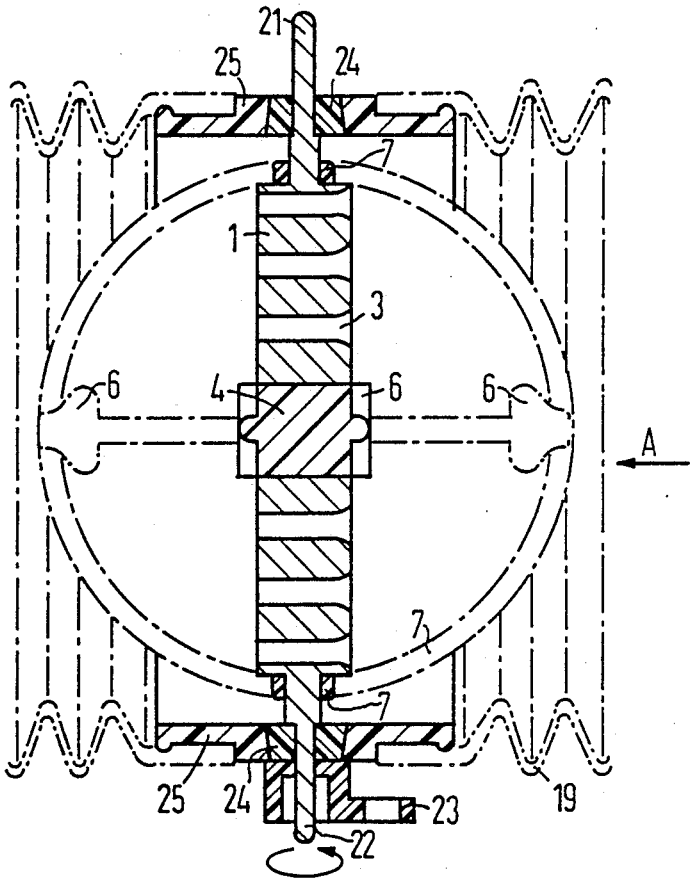
FIG. 9 is a cross sectional view of a heating element embodying the principles of the invention in which the heating element is rotatably mounted in a pipeline system.

There is shown in FIG. 9 another heating element embodying further principles of the invention. The heating element shown in the FIG. 9 is suitable for use in a defroster channel or conduit 19 in a motor vehicle and the like.

The fundamental structure of the heating element has already been described. But, in addition, the heating element in the FIG. 9 includes contacts 21 and 22 through which current is supplied to each PTC resistor 11. The contacts 21 and 22 also serve as mounting elements for mounting of the heating element in an annular housing 25 of synthetic resin material. The housing 25, which receives the ends of conduits 19, includes self lubricating bushings 24 in the respective bores of which the heating element is pivotally mounted. The contact pins 21 and 22 are inserted into the bushings 24 and serving as pivot pins.

Outside of the housing 25, a rotating lever 23 is applied to the contact pin 22. The element can be rotatably positioned by appropriate rotation of the lever 23. Rotatable positioning of the heating element serves to throttle the flow of the flowing medium thus, the heating element serves as a throttle valve.

In the rest position, i.e. when heating of the flowing medium (e.g. the defroster air) is not desired, the heating element is positioned parallel to the flow of the medium in the channel 19, as shown by the broken lines depicting the heating element, to keep flow resistance as low as possible. In operation, the heating element is rotated 90° and is positioned transversely to the flow of the medium. When an operating voltage is applied appropriately to the contact pins 21 and 22, the flowing medium (e.g. the defroster air) is heated.

Figure 10:
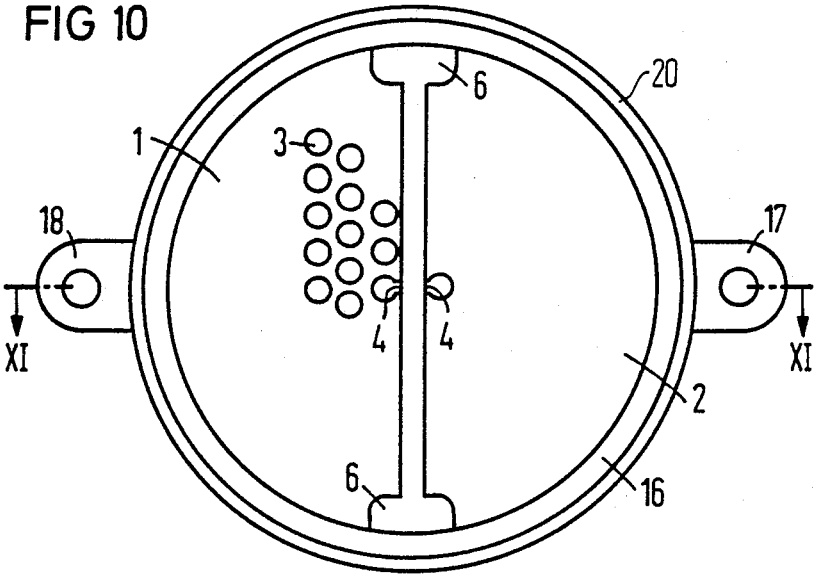
FIG. 10 a plan view of a heating element embodying further principles of the invention in which the heating element is provided with current supply brackets.

In FIG. 10, a third embodiment of a heating element embodying principles of the invention is shown. Again, the fundamental of the heating element structure has been described. This embodiment includes a specially designed casing 16 so that the heating element can be installed in a pipeline system 19' (see FIG. 11). The heating element is further provided with current supply brackets 17 and 18, which are in direct contact with the individual bodies 1 and 2. The bodies 1 and 2 are electrically coupled to each PTC resistor 11 via the electrically conductive adhesive 15 and therefore, current can be supplied to each PTC resistor 11 through the brackets 17 and 18.

Figure 11:
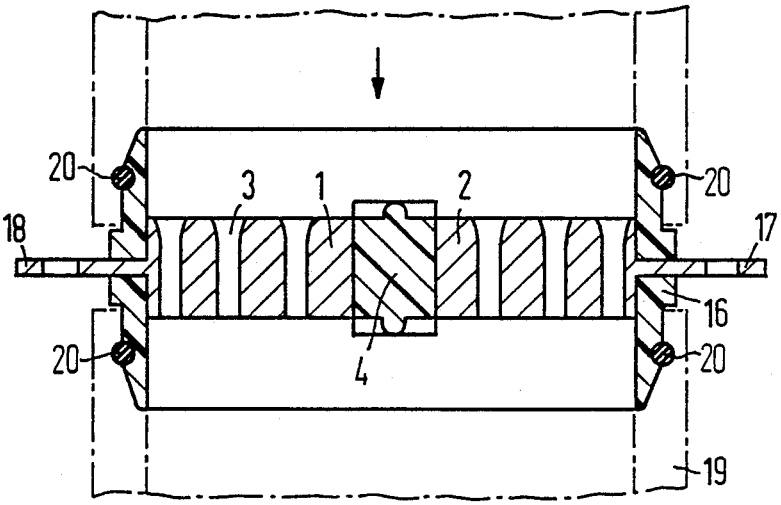
FIG. 11 is a cross sectional view taken along the line XI—XI of FIG. 10.

In FIG. 11, it can be seen that the current supply brackets 17 and 18 are directly molded to the individual bodies 1 and 2, respectively. The annular casing 16 contains additional recesses in which sealing rings 20 are accommodated. The sealing rings 20 provide improved sealing between the pipeline system 19' and the heating element.

For the preceding embodiments, depending upon the structural shape of the PTC resistor 11, the operating voltage range of same extends from 6 volts to 240 volts. At 240 volts, power levels of up to 800 watts can be achieved. The highest attainable temperature is 250° C. due to the efficiency of the adhesive 15 and of the synthetic resin material casing 14.

The materials most suitable for use as the adhesive 15 are described and disclosed in U.S. Pat. No. 3,898,422, which is incorporated herein by reference thereto. However, it is possible to use another material so long as it fulfills the following criteria:

thermal resistance of at least 250° C.;

excellent electrical conductivity, having a maximum specific resistance of 0.001 ohm×cm;

outstanding thermal conductivity of at least 12 W/mK;

a linear thermal expansion coefficient within the range from 60 to $80\times10^{-6}$ 1/K;

a tensile strength from 20 to 30 kg/cm$^2$;

elastic properties;

grain size of the solid component being less than 15 m; and amount of solids approximately 72% by weight, solids including, for example, silver-plated copper particles.

The composition of the synthetic resin material which is used is also important. On the one hand, the synthetic resin material protects each ceramic PTC resistor 11 both mechanically and chemically from the medium which is to be heated. On the other hand, the synthetic resin material minimizes the thermal-mechanical forces to which the adhesive connection 15 and PTC resistor 11 are subjected, by the mechanical fixing of the individual bodies 1 and 2. Furthermore, the synthetic resin material insulates the individual bodies 1 and 2 from electrically conductive pipeline walls and, if necessary, also serves as thermal insulation. As a result, the synthetic resin material is subject to the following requirements:

thermal resistance of at least 250° C.;

linear thermal expansion coefficient of a maximum of $22\times10^{-6}$ 1/K;

combustibility in accordance with Underwriters Laboratories, Inc. regulation UL 94 V/O, i.e. self-extinguishing:

resistance to the medium which is to be heated; and tensile strength of at least 100 N/mm2.

A material which fulfills these requirements is polyphenylene sulphide, reinforced with glass fibers or glass spheres, produced by L.N.P. Plastics, Netherlands B.V., which has a glass composition of 40% by weight.

The individual bodies 1 and 2 which effect the heat exchange between the PTC resistor and the medium are preferably produced from aluminum or an aluminum alloy by die-casting. Depending upon the application, their outer shape is round, oval or polygonal. At least two such heat exchangers or bodies are required to construct the heating system. At the respective connection location, where they are joined, the heat exchangers have a planar surface for the accommodation of the PTC-elements. Possible basic shapes of the metallic body, composed of the individual bodies 1 and 2 are, for example, a cylinder consisting of four quarters or a cylinder consisting of two halves. A three-part cylinder, composed of a central block with parallel connecting surfaces and two cylinder segments, can also be formed, in which case the central block is connected to the plus pole and the two cylinder segments are connected to the minus pole of the voltage source.

It should be noted that the individual bodies serve as current conduits and therefore provisions must always be made for connecting both a positive and a negative voltage to a PTC-resistor arranged between two individual bodies. For example, one individual body can serve as the positive terminal while the other can serve as the negative terminal. The supply current of the individual bodies can take place via terminals or plugs plugged into a passageway, pressure springs, or similar electrically conductive components. In any application, however, it should be noted that the flowing medium must as a maximum have a low electrical conductivity in order to avoid a short-circuit between the individual bodies.

In order to reduce the flow resistance the individual bodies are provided with a plurality of regularly arranged passageways 3 which have a circular cross-section. The internal width of each tapered passageway 3 reduces from the inlet side with a constant radius of curvature up to a maximum of ⅓ of the length of the passageways 3, and then remains constant to the outlet side, each tapered inlet having a maximum taper of 2 angular degrees over the entire thickness of the body.

In the inlet zone the radii of curvature of the individual passageways 3 converge to form the sharp edges 5 except for one edge so that no surfaces remain transverse or perpendicular to the direction of flow. Each of these edges 5 has a radius of 0.1 to 0.2 mm. A plan view of the passageways 3 then shows a honeycomb-like formation comprising a plurality of individual hexagonal structures as shown in FIG. 1.

The volume of the metallic body excluding the volume of the passageways 3 is equal to or up to 30% greater than the volume of the passageways 3.

In order to achieve the most simple and cost effective production of the individual bodies, it is advisable to assemble the entire heat-exchanging metallic body from individual bodies of identical construction.

Compared to the known ceramic honeycomb structures or other heating devices with asymmetrical coupling of heat output of PTC resistors, the present invention results in a distinct reduction in energy usage costs on the order of up to 40%. This is achieved by a plurality of factors. On the one hand, contacting springs, high-cost housing constructions and insulating components are avoided. On the other hand, by virtue of the symmetrical coupling of the PTC resistor heat output, the number of PTC resistors required is reduced. The construction consists only of four different types of components, the PTC resistor(s), the heat exchangers, the adhesive and the synthetic resin material casing.

In the construction of the heating element, the first assembly step consists of adhesive bonding of the ceramic PTC resistor(s) using the individual components of the individual metallic bodies 1 and 2 heat exchanger, a PTC resistor 11 and adhesive 15. The final assembly step consists of extrusion coating the PTC resistor 11 with the casing 14 and forming of the bridges 4 and 6 with the synthetic resin material. The overall assembly is thus limited to two steps, which can be implemented in cost-effective fashion in mass production.

While preferred embodiments have been described modifications and changes may become apparent to those skilled in the art which shall fall within the spirit and scope of the invention. It is intended that such modifications and changes be covered by the attached claims.

We claim as our invention:

1. A heating element for heating a flowing medium comprising:

a plurality of metallic bodies arranged in side-by-side juxtaposed relationship and means for mechanically fixing the bodies together along juxtaposed boundary surfaces thereof to form a substantially cylindrically shaped heat exchanger, said metallic bodies having a plurality of regularly arranged passageways for the medium to flow through the bodies, said passageways being tapered in a conical fashion at inlets thereof in the direction of the flow of the medium, said means for fixing including at least one bridge formed of an electrically insulating synthetic resin material having a thermal expansion coefficient equal to that of the metallic bodies, which extends across said juxtaposed boundary surfaces of adjacent metallic bodies and through a passageway located in each body adjacent the boundary surface thereof, said metallic bodies having a volume excluding the volume of the passageways being at least equal to the volume of the passageways, said metallic bodies being made of a good heat conducting metal;

at least one disc-like positive temperature coefficient ceramic PTC resistor located between the juxtaposed boundary surfaces of two adjacent metallic bodies;

said at least one ceramic PTC resistor having large surfaces with a covering mechanically attached and electrically coupled to the boundary surface of the respective adjacent metallic body by an electrically and thermally conductive adhesive, any cavity remaining between the boundary surfaces and around said at least one ceramic PTC resistor being filled to encase said ceramic PTC resistor in a casing of the electrically insulating synthetic resin material, said casing insulating said at least one ceramic PTC resistor from external influences, said synthetic resin material having virtually the same thermal expansion coefficient as the metallic bodies; and said metallic bodies having means for forming a connection to a current supply to provide current to said at least one ceramic PTC resistor.

2. A heating element according to claim 1, wherein said metallic bodies are made of a good heat conducting metal selected from the group of consisting of aluminum, copper, alloys containing a high percentage of aluminum and alloys containing a high percentage of copper.

3. A heating element according to claim 1, wherein the heat exchanger further includes an annular casing made of said synthetic resin material, which annular casing encases a peripheral surface of the heat exchanger.

4. A heating element according to claim 1, wherein the synthetic resin material used to mechanically fix the metallic bodies to each other and to fill the cavity surrounding the ceramic PTC resistor is injection moldable and sufficiently elastic in a hardened state at an operating temperature and consists of polyphenylene sulphide reinforced 30 to 50 percent by weight with glass selected from the group consisting of glass fibers and glass spheres.

5. A heating element according to claim 1, wherein the heating element is adopted to be installed in a pipeline system.

6. A heating element according to claim 1, wherein said plurality of adjacent metallic bodies are mechanically fixed to one another by at least one bridge made of the synthetic resin material connecting one said passageway in each of said juxtaposed metallic bodies and extending therebetween a channel comprising a slot milled in each said passageway at the boundary surface and along the entire thickness of the respective metallic body.

7. A heating element according to claim 1, wherein the means for forming a connection includes at least one of the two juxtaposed metallic bodies having a bracket molded thereto for electrically coupling the at least one metallic body to the current supply.

8. A heating element according to claim 1, wherein the heat exchanger includes a pair of pins connected to the metallic bodies and located diametrically opposite to each other, said pins simultaneously serving as electrical contacts for the means for forming a connection to the current supply and as pivot pins upon which the heat exchanger can rotate.

9. A heating element according to claim 1, wherein the conically shaped inlets of the adjacent passageways in the metallic bodies overlap to form sharp edges between adjacent passageways to thereby reduce the flow resistance of the heat exchanger.

10. A heating element according to claim 1, wherein an internal width of each tapered passageway reduces from the inlet with a constant radius of curvature up to a maximum of ⅓ of the length of the passageway, each inlet having a maximum taper of 2 annular degrees over the thickness of a metallic body.

11. A heating element for heating a flowing medium, comprising:

at least two adjacent metallic bodies arranged in juxtaposed side-by-side relationship and being mechanically fixable to each other along juxtaposed boundary surfaces to form a heat exchanger, said metallic bodies being made of a good heat conducting metal and having a plurality of regularly arranged passageways extending therethrough at least some of which include inlets tapered in the flow direction of the medium, at least one positive temperature coefficient ceramic heating element located between the juxtaposed boundary surfaces of the adjacent metallic bodies and each having opposite large surfaces mechanically attached and electrically coupled to an adjacent boundary surface by an adhesive;

means for electrically connecting each positive temperature coefficient ceramic heating element to a power source; and electrically insulating synthetic resin material disposed in the space between the juxtaposed bodies and filling any cavity surrounding the at least one ceramic heating element to encase each at least one ceramic heating element in a casing to insulate it from the medium, extending through selected pairs of passageways located along the juxtaposed boundary surfaces and above the metallic bodies in an integral unit to form at least one synthetic resin bridge which mechanically fixes the metallic bodies together and surrounding a periphery of the metallic bodies in an annular structure to further mechanically fix the metallic bodies together in an annular casing, said synthetic resin material having a thermal expansion coefficient equal to a thermal expansion coefficient of the metallic bodies.

12. A heating element as set forth in claim 11, wherein said metallic bodies are made of a good heat conducting metal selected from the group of consisting of aluminum, copper, alloys containing a high percentage of aluminum and alloys containing a high percentage of copper.

13. A heating element as set forth in claim 11, wherein the synthetic resin material used to mechanically fix the metallic bodies to each other and to fill the cavity surrounding the heating element is injection moldable and sufficiently elastic in a hardened state at an operating temperature and consists of polyphenylene sulphide reinforced 30 to 50 percent by weight with glass selected from the group consisting of glass fibers and glass spheres.

14. A heating element as set forth in claim 11, wherein an internal width of each tapered passageway reduces from the inlet with a constant radius of curvature up to a maximum of $\frac{1}{3}$ of the length of the passageway, each inlet having a maximum taper of 2 annular degrees over the thickness of a metallic body.

15. A method for forming a heating element for heating a flowing medium comprising the steps of:

adhesively bonding opposite large flat surfaces of a disk-like ceramic heating element to boundary surfaces of two adjacent juxtaposed side-by-side metallic bodies;

extrusion coating the ceramic heating element to fill any cavity between the juxtaposed metallic bodies and around the ceramic heating element with a synthetic resin material having the same thermal expansion coefficient as the metallic bodies; and mechanically fixing the metallic bodies to each other by a bridge of synthetic resin material connecting the two metallic bodies formed by filling a pair of passageways, one passageway located along each juxtaposed boundary surface, with said synthetic resin material and filling a channel extending between and communicating with said passageways with more of the synthetic resin material.

16. A method as set forth in claim 15, further including the step of forming a second bridge connecting the adjacent metallic bodies by filling a pair of additional passageways, one passageway located along each juxtaposed boundary surface, with the synthetic resin material and forming projections of the synthetic resin material which extend from said additional passageways and which connect to form an integral loop through said additional passageways.

17. A method as set forth in claim 16, further including the step of surrounding a periphery of said metallic bodies in annular fashion with the synthetic resin material.

* * * * *